US010731835B2

(12) United States Patent
Ross

(10) Patent No.: US 10,731,835 B2
(45) Date of Patent: Aug. 4, 2020

(54) ILLUMINATION DEVICE

(71) Applicant: First-Light USA, LLC, Seymour, IL (US)

(72) Inventor: Jeremy B. Ross, Monticello, IL (US)

(73) Assignee: First-Light USA, LLC, Seymour, IL (US)

( * ) Notice: Subject to any disclaimer, the term of this patent is extended or adjusted under 35 U.S.C. 154(b) by 0 days.

(21) Appl. No.: 16/202,627

(22) Filed: Nov. 28, 2018

(65) Prior Publication Data

US 2019/0178477 A1 Jun. 13, 2019

Related U.S. Application Data

(60) Provisional application No. 62/596,046, filed on Dec. 7, 2017.

(51) Int. Cl.

| | |
|---|---|
| ***F21V 21/008*** | (2006.01) |
| ***F21V 21/08*** | (2006.01) |
| ***F21V 23/04*** | (2006.01) |
| ***F21V 33/00*** | (2006.01) |
| ***F21V 21/084*** | (2006.01) |
| ***F21V 21/088*** | (2006.01) |
| *F21Y 115/10* | (2016.01) |

(52) U.S. Cl.

CPC ..... *F21V 21/0885* (2013.01); *F21V 21/084* (2013.01); *F21V 21/0816* (2013.01); *F21V 23/0414* (2013.01); *F21V 23/0435* (2013.01); *F21V 33/0056* (2013.01); *F21Y 2115/10* (2016.08)

(58) Field of Classification Search

CPC ..... F21V 21/0816; F21V 21/084; F21V 21/0885; F21V 23/0414; F21V 23/0435; F21V 33/0056

See application file for complete search history.

(56) References Cited

U.S. PATENT DOCUMENTS 5,083,246 A 1/1992 Lambert
6,224,235 B1 5/2001 Parker
(Continued)

FOREIGN PATENT DOCUMENTS

CN 203656591 U 6/2014

OTHER PUBLICATIONS

International Search Report and Written Opinion dated Feb. 12, 2019, from the ISA/US, for International Application No. PCT/US18/52773 (filed Nov. 28, 2018), 10 pages.
(Continued)

*Primary Examiner* — Thomas M Sember
(74) *Attorney, Agent, or Firm* — Ascenda Law Group, PC

(57) ABSTRACT

Illumination devices characterized in that they include one or more light sources disposed within a housing attached to a clip adapted to receive a portion of a wearer's headdress, for example a chin strap or bill of a cap. An upper surface of the clip may be shaped to be worn under the wearer's chin and may also include a groove adapted to facilitate attachment of the illumination device to nylon or other strap-like webbing. One or more of the light sources is operable by a switch mounted on an opposite side of the housing from the clip when the clip is in a closed position, that is, when the clip rests on an upper surface of the housing. In addition to light sources, the illumination device may further include one or more imaging devices, e.g., a camera, and/or audio communication devices, e.g., a microphone.

20 Claims, 9 Drawing Sheets

(56) References Cited

U.S. PATENT DOCUMENTS

| | | | |
|---|---|---|---|
| 6,604,837 | B2 | 8/2003 | Sandberg |
| 6,619,813 | B1 | 9/2003 | Schnell |
| 8,851,697 | B2 | 10/2014 | Quitner |
| 9,366,419 | B2 | 6/2016 | Osborn |
| 9,732,948 | B1 | 8/2017 | Malina et al. |
| 2017/0163942 | A1 | 6/2017 | Teetzel |

OTHER PUBLICATIONS

International Application No. PCT/US2018/062773 filed Nov. 28, 2018; International Preliminary Report on Patentability dated Mar. 4, 20202; IPEA/US; 15 pp.

ILLUMINATION DEVICE

RELATED APPLICATIONS

This is a NONPROVISIONAL and claims the priority benefit of U.S. Provisional Application No. 62/596,046, filed Dec. 7, 2017, which is incorporated herein by reference.

FIELD OF THE INVENTION

The present invention relates generally to illumination devices and, more particularly, to such illumination devices as are intended to be worn on the person of a user.

BACKGROUND

Illumination devices find application in a variety of fields and activities. Such devices as are intended to be worn on the person of a user are often worn atop a wearer's head, e.g., secured by or to a strap, cradle, or helmet, etc., or positioned on or in spectacle frames, e.g., near the wearer's temples. The benefit of such head-worm illumination devices is that they leave the wearer's hands free to perform tasks other than holding the illumination device.

SUMMARY OF THE INVENTION

Various embodiments of an illumination device are described herein. In one or more of those embodiments, an illumination device includes one or more light sources disposed within a housing. The housing is attached to a clip, which clip is adapted to receive a portion of a wearer's headdress or a strap. One or more of the light sources is operable by a hands-free switch mounted on an opposite side of the housing from the clip when the clip is in a closed position. The one or more light sources may be lamps, but preferably are light emitting diodes (LEDs). The clip is preferably adapted to receive a chin strap or other strap and shaped to be worn under the wearer's chin, on the back of the hand or glove, on a ball cap brim, or otherwise worn.

In addition to light sources, the illumination device may further include one or more imaging devices, e.g., a camera, in the housing. So too may audio communication devices, e.g., a microphone, be included.

Where only one of the light sources is operable by the hands-free switch, others of the light sources may be operable by one or more other switches, and/or be operable under the control of a programmable controller.

A further embodiment of the invention provides an illumination device having a light source operable by a hands-free switch mounted to a housing, where the housing is attached to a clip adapted to receive a chin strap of a wearer's headdress or other attachment means. As before, the light source may be a lamp but preferably is an LED. The switch is preferably mounted on an opposite side of the housing from the clip when the clip rests on an upper surface of the housing.

The clip may include a groove adapted to facilitate attachment of the illumination device to nylon or other strap-like webbing. The clip may further have an upper surface cupped to receive a wearer's chin.

In various embodiments, the housing may be fashioned from one or more of plastic, metal and/or a metal alloy, carbon fiber, cellulose acetate, and an epoxy resin.

These and further embodiments of the present invention are discussed in more detail below.

BRIEF DESCRIPTION OF THE DRAWINGS

The present invention is illustrated by way of example, and not limitation, in the figures of the accompanying drawings, in which.

DESCRIPTION

Described herein are examples of an illumination device intended to be worn on the person of a user. Illumination devices configured in accordance with embodiments of the present invention are suitable for application in a variety of contexts, including military, law enforcement, consumer recreational, and others. Illumination devices configured in accordance with embodiments of the present invention can be worn with or without a helmet, hat, or other headdress, and can also be attached to straps worn on a user's head, hand, or elsewhere, and can also be attached to nylon or other strap-like webbing. Conveniently, illumination devices configured in accordance with embodiments of the present invention provide lighting for a user in the direction of the wearer's view. The inclusion of hands-free operable switches allows for activation/deactivation of the light source without the use of the wearer's hands. Additionally, a hinged mount allows for adjustment of the axis of illumination.

As discussed in greater detail below, embodiments of the present illumination device are characterized in that they include one or more light sources disposed within a housing. The housing is hingibly attached to a clip, loadable from either direction and adapted to receive a mounting strap, such as portion of a wearer's headdress (e.g., a chin strap or bill of a cap), one worn on a user's head, hand, or elsewhere, and/or one associated with nylon or other strap-like webbing. In some instances, an upper surface of the clip may be shaped to be worn under the wearer's chin, and thus may be personalized to the wearer. The clip may also include one or more grooves or detents adapted to prevent detachment of the illumination device once secured to the mounting strap.

One or more of the light sources of the illumination device may be operable by a hands-free switch mounted on an opposite side of the housing from the clip when the clip is in a closed position, that is, when the clip rests on an upper surface of the housing. Where only one of the light sources is operable by the hands-free switch, others of the light sources may be operable by one or more other switches, and/or be operable under the control of a programmable controller. The one or more light sources may be lamps, but preferably are LEDs. In addition to light sources, the illumination device may further include one or more imaging devices, e.g., a camera, in the housing. So too may audio communication devices, e.g., a microphone, be included.

Figure 1:
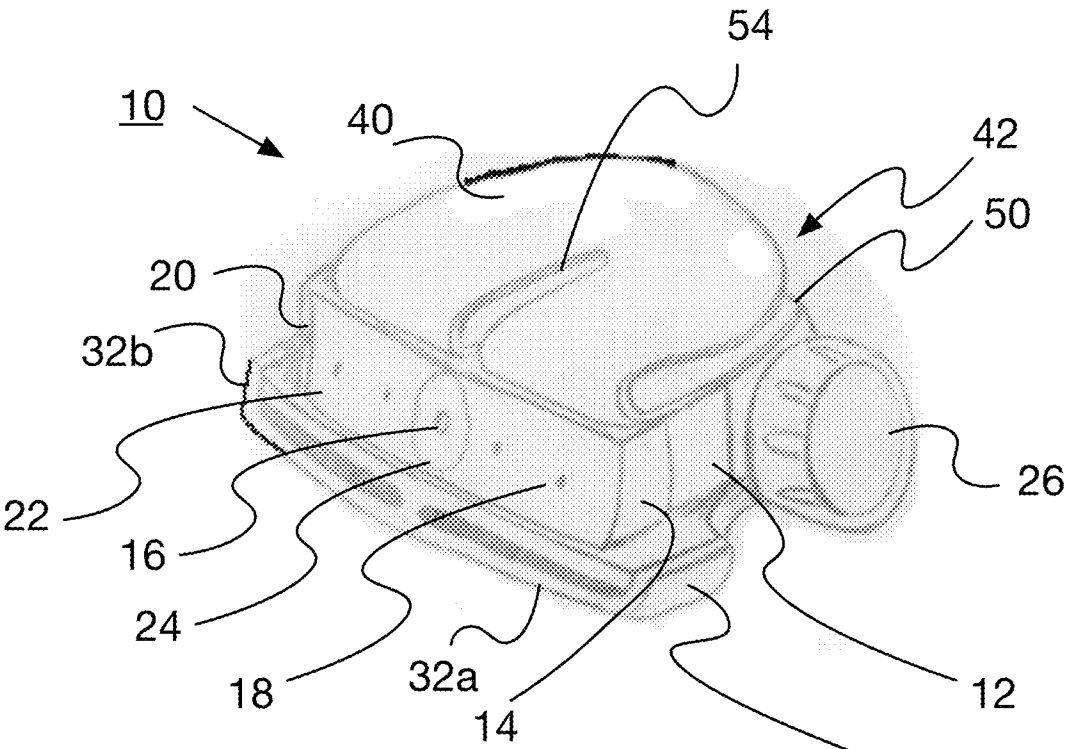
FIG. 1 illustrates an example of an illumination device configured in accordance with embodiments of the present invention.

FIG. 1 illustrates an example of an illumination device 10 configured in accordance with embodiments of the present invention. The illumination device includes a housing 12 at the front of which is a light source array 14. The light source array 14 includes a primary light source 16, which may be an incandescent lamp but is preferably a light emitting diode (LED), and one or more secondary light sources 18, which likewise may be incandescent lamps but are preferably LEDs, arranged on either side of the primary light source. The secondary light sources are optional, and when present may be arranged in patterns on either side of the primary light source. In the illustrated embodiment, the secondary light sources are arranged two per side of the primary light source in linear alignment therewith along a horizontal axis of the light source array, but this is merely one example of a possible arrangement thereof. In some cases, the secondary light sources may be arranged in circular, arrow, or grid patterns on either or different sides of the primary light source. That is, the secondary light sources on one side of the primary light source may be arranged differently than the secondary light sources on the opposite side of the primary light source. Further, secondary light sources in addition to or in lieu of ones placed to the sides of the primary light source may be positioned above and/or below the primary light source.

The primary light source 16 and, when present, one or more of the secondary light sources 18, preferably emit light in the visible light spectrum. Often, the primary light source will emit white light, but this is not necessarily so and instead the primary light source may emit light at other or additional wavelengths. Alternatively, the primary light source may emit white light, but an optional filter may be positioned thereover so as to allow only specific wavelengths to pass. Such a filter may be supported by a lip 20 around the front of light source array 14.

One or more of the secondary light sources 18 may emit light in the ultra violet or infra-red spectrums. Such secondary light sources are useful, for example, when the illumination device is employed as a signaling mechanism and the wearer does not wish to divulge his/her position by emitting visible light which may be seen by others with the naked eye. It is contemplated that the primary light source 16 may also emit light in the ultra violet or infra-red spectrums, but most often will be a source of white light or colored light. In some instances, the primary light source may be a dual- or multi-source LED with one emitter for white light and one or more separate emitters for non-white light, including but not limited to light outside of the visible spectrum.

At the front of light source array 14 is a face plate 22. Face plate 22 may include baffles for the various light sources. In some instances, face plate 22 may support irises for one or more of the light sources to allow control over the amount of light emitted. Also, face plate 22 may include a lens mount 24 for the primary light source to allow for the placement of one or more lenses, filters, or covers.

At the rear of housing 12 is a screwably-mounted battery cover 26. The illumination device 10 is adapted to be powered by one or more alkaline, lithium ion, metal hydride, or other batteries. In one embodiment, a single AAA-size or AA-size alkaline battery may be used, but the use of replaceable batteries of other sizes or configurations is also contemplated. Batteries may be placed in/removed from the illumination device by unscrewing the battery cover 26, removing a used battery (if present) from the associated compartment in housing 12, replacing it with a new or recharged battery, and then replacing the battery cover 26. While a screw mount for battery cover 26 is preferred, other mounting arrangements, such as a bayonet mount or a snap-top mount may be used.

Figure 2:
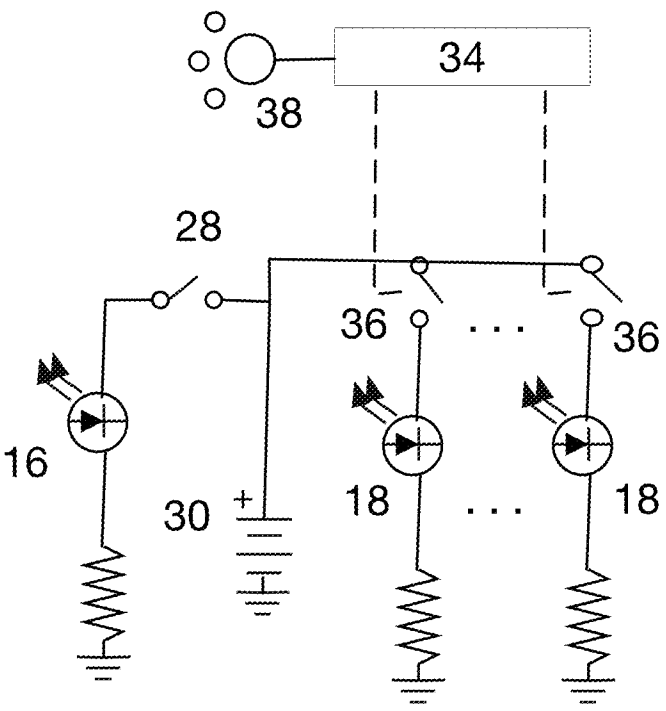
FIG. 2 is a simplified schematic showing electronic circuitry for the illumination device shown in FIG. 1.

All of the electronic circuitry for the illumination device is included within the confines of housing 12 (which preferably is watertight) and a simple schematic showing such circuitry is shown in FIG. 2. Primary light source 16 is electrically coupled to a battery 30 via switch 28. As shown in FIG. 1, the hands-free operable switch 28 may be implemented as a chin switch which is located below housing 12. More generally, the hands-free operable switch 28 has left and right sections 32*a* and 32*b*, respectively. To turn the primary light source 16 on or off, either one of the left or right sections 32*a*, 32*b* is depressed towards the bottom surface of housing 12. This displacement causes the switch to be electrically closed or opened, depending on its current state, thereby coupling or decoupling, respectively, the primary light source 16 to battery 30. As will become apparent from the description below, actuation of the switch in this fashion may be accomplished in a hands-free fashion by the user, for example by pressing his/her chin against his/her shoulder when the illumination device 10 is worn on a chin strap.

FIG. 2 also shows an optional arrangement of secondary light sources 18, which may be turned on/off using a controller 34 (e.g., an 8-bit microcontroller with on-board solid-state memory). In one embodiment, controller 34 is a programmable unit that may cause the secondary light sources 18 to be turned on/off via associated switches 36 (which may be transistors under the operable control of controller 34) according to one or more desired patterns. Activation of the programmed pattern may be achieved using a slider or rotary switch 38 which has various positions, each of which is associated with an individual programmed pattern for illumination of secondary light sources 18. Switch 38 may be accessible on the outside of housing 12, but in other instances may only be accessible by removing battery cover 26 or by opening housing 12 and setting switch 38 in a desired program mode. In other embodiments, both the primary illumination source 16 and one or more secondary illumination sources 18 may be switched on/off using the hands-free switches 32*a*, 32*b*. Also, primary illumination source 16 may have one or more modes of illumination, e.g., where the primary illumination source is a multi-mode LED, and so may be under the control of controller 34, with hands-free switches 32*a*, 32*b* providing selection of a program mode.

Returning to FIG. 1, housing 12 is hingibly-mounted, at its rear, to the bottom of clip 40. Clip 40 is molded in the shape of an elongated "U", with a thin recess 42 between its upper and lower members to receive a chin or other strap (see FIGS. 3-4 and 7-8), the bill of a cap (see FIG. 6), or other attachment means. The hinged coupling between clip 40 and housing 12 allows the illumination device 10 to be rotated about the axis of the hinge when worn. As shown in FIGS. 3, 4, 7, and 8 the illumination device 10 may be worn, via clip 40, by attachment to a chin strap 46 of a helmet, head strap 56, or strap 58 worn on a user's hand or glove, and pivoted about the hinge at the rear of the housing to change the axis of illumination from the primary and/or secondary light sources. A catch or detent 44 may be included on the underside of the top member of clip 40 to secure it to a chin or other strap when so worn. In various embodiments, the hinged connection 50 between the clip and the housing may comprise a piano hinge, butt hinge, barrel hinge, butterfly hinge, pivot hinge, spring hinge, or other arrangement, and may be detachable so as to allow replacement of the clip if it becomes worn or needs to be replaced/resized for a different user.

The top member of clip 40 may be "U" shaped across its lateral dimension so as to comfortably cup a wearer's chin. In some embodiments, the top member of clip 40 may be made of a malleable material so as to permit some customization to a wearer's chin. Clips 40 may be provided in various sizes to accommodate chin sizes and shapes of different wearers, or they may be adjustable at one or more points to accomplish same. In some instances, clips 40 may be personalized to a wearer by creating a model, either physical or digital, of the wearer's chin and fabricating a clip specifically to suit the wearer according to the dimensions provided from the model. Modern additive manufacturing processes (commonly known as 3D printing) make such customizations economically feasible even for consumer applications and custom clips could be readily produced from images of a wearer's chin captured using computer-based cameras and transmitted to remote server hosting a Web service for purchase of the illumination device and accessories therefor. For example, following instructions provided by the Web-based service, a user may capture multiple still images and/or a short video of his/her chin. By including an object of known dimensions (e.g., a ruler, a credit card, etc.) within the field of view of the camera at the approximate position of the user's chin as the images are captured, an accurately sized 3D model of the user's chin can be created at the server. The user can then be provided with an opportunity to customize a clip 40 to be sized to the dimensions of the model, selecting, for example, the material from which the clip is to be fabricated, whether or not to include a pad (e.g., silicone, leather, or other material) on its upper surface, and other parameters of the to-be-manufactured clip. Once the customizations are specified, and payment collected, the clip specification may be dispatched to a manufacturing facility at which the clip is fabricated.

The housing and other components of illumination devices of the kind described herein may be fashioned from a variety of materials, including but not limited to plastics (e.g., zylonite), metals and/or metal alloys, cellulose acetates (including but not limited to nylon), carbon fiber, epoxy resins, and combinations of the foregoing, and in particular the clip 10 may be fashioned from any of the above as well as from natural horn and/or bone. Fabrication processes for the housing, clip, and other components include, but are not limited to, injection molding, sintering, milling, and die cutting. Alternatively, or in addition, one or more additive manufacturing processes, such as extrusion, vat photopolymerization, powder bed fusion, material jetting, or direct energy jetting, may be used to fashion the illumination device and/or components thereof.

Figure 4:
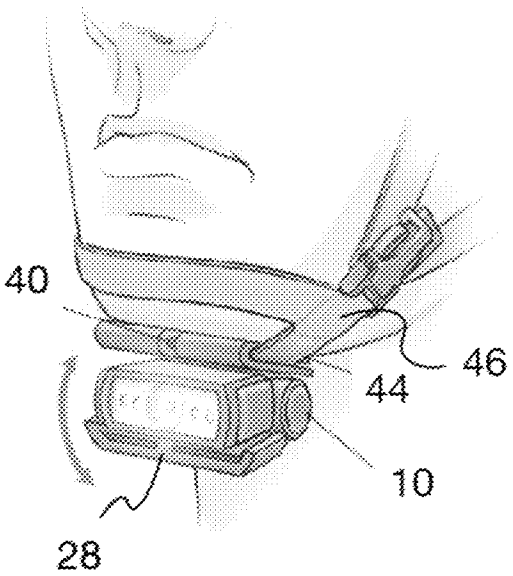
FIGS. 3 and 4 show examples of an illumination device configured in accordance with embodiments of the present invention worn via a pivotable clip attachment to a chin strap of a helmet, allowing the wearer to change the axis of illumination from primary and/or secondary light sources.
Figure 3:
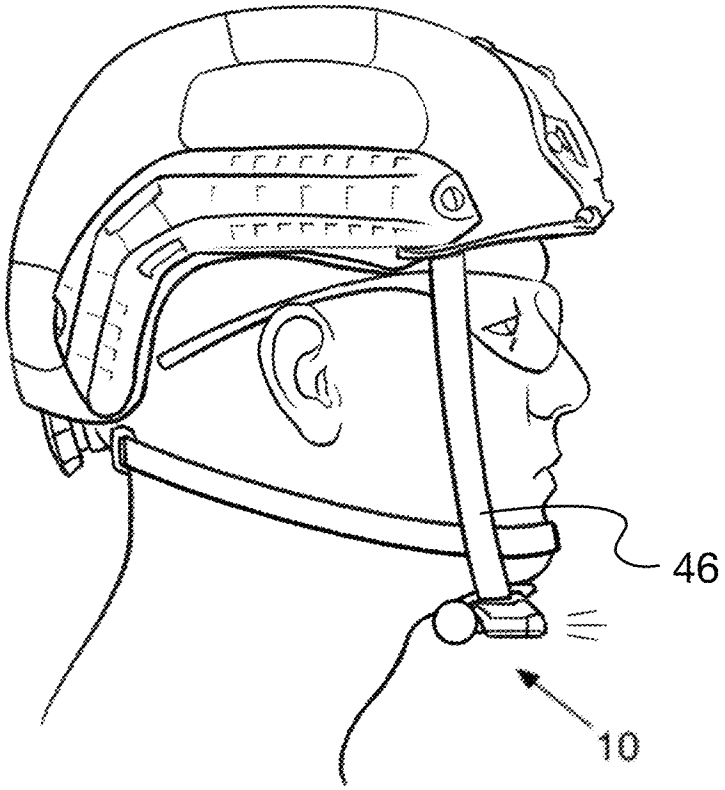
Figures 5, 6:
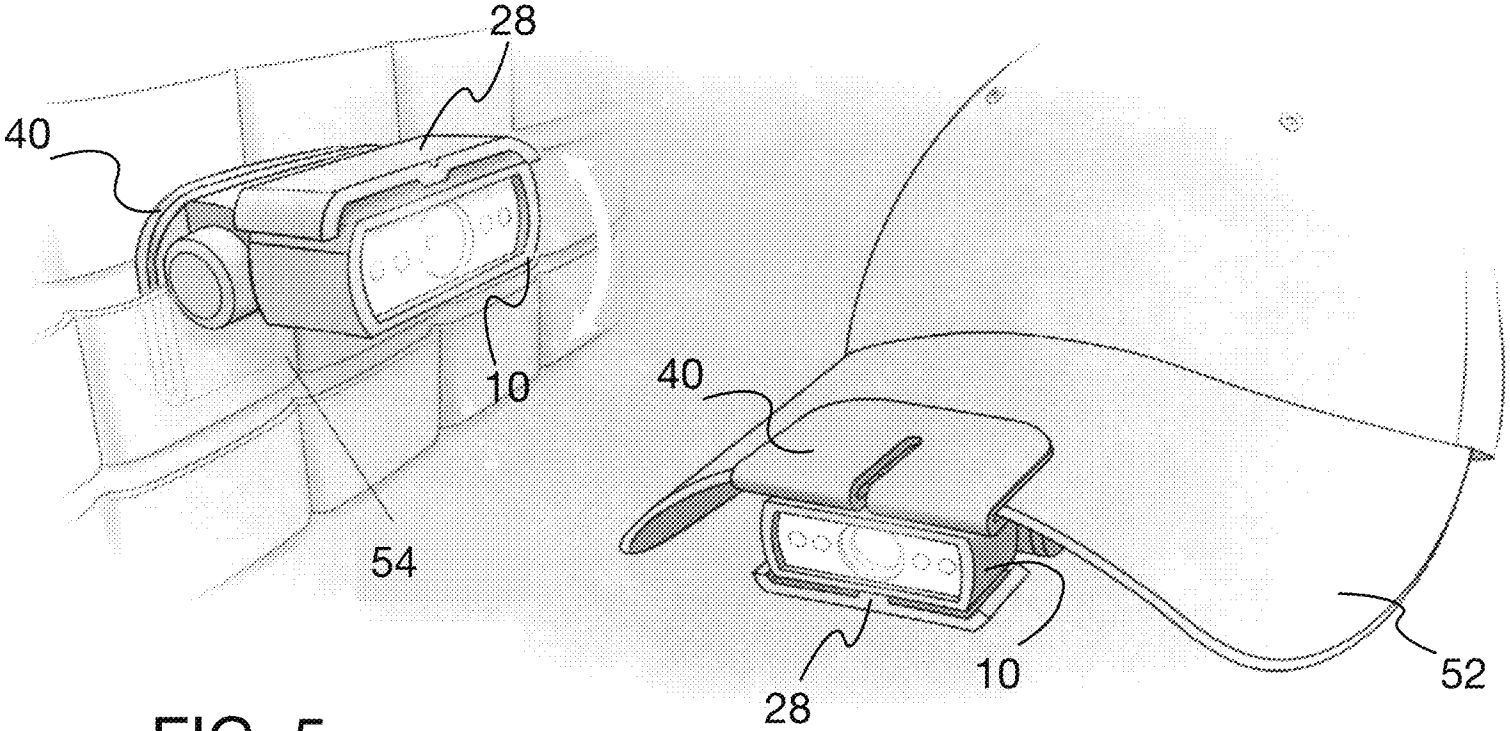
FIG. 5 illustrates an example of an illumination device configured in accordance with embodiments of the present invention worn mounted on nylon strap-like webbing.
FIG. 6 illustrates an example of an illumination device configured in accordance with embodiments of the present invention worn attached to the bill of a cap.
Figure 8:
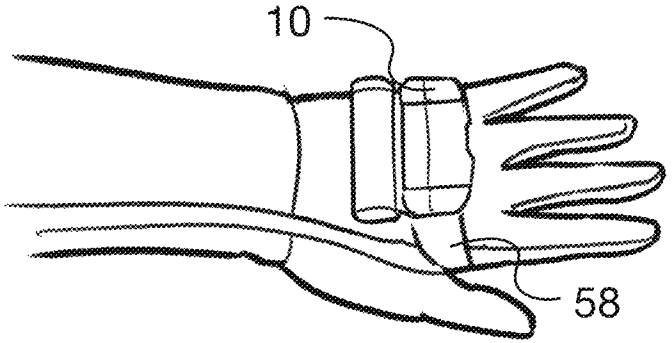
FIG. 8 illustrates an example of an illumination device configured in accordance with embodiments of the present invention worn attached to a strap over the back of a wearer's hand or glove.
Figure 7:
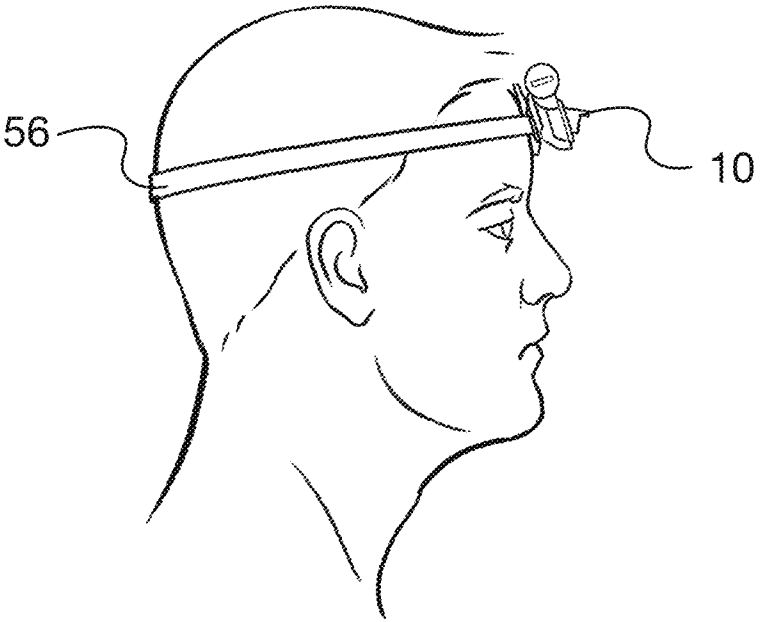
FIG. 7 illustrates an example of an illumination device configured in accordance with embodiments of the present invention worn attached to a head strap.

In addition to being wearable under the chin as shown in FIGS. 3 and 4, the present illumination device may be worn attached to the bill of a cap 52, as illustrated in FIG. 6, or mounted on nylon strap-like webbing 54, as shown in FIG. 5. To assist in such a mounting, groove 54 is provided in clip 40. As shown in the illustration, clip 40 is rotated fully open and slipped into adjacent folds in the webbing, with groove 54 engaging a rib between the folds. In such a situation, the illumination device is secured in an inverted fashion from when it is worn under the chin, with the hands-free switch 28 on top.

Illumination devices configured in accordance with embodiments of the present invention provide a relatively small (in terms of area being occupied), augmentative, illumination source that does not interfere with eye protection, loupes, masks, etc. when worn by a user. Such illumination devices allow users to avoid shadowing that occurs within cavities when using ceiling-mounted or other overhead light sources.

In addition to lighting, the present illumination devices provide a platform for image and/or video capture and/or projection devices. For example, rather than or in addition to secondary light sources 18, one or more cameras may be included alongside the primary light source 16. Further, one or more microphones may be provided in place of or in addition to the secondary light sources. Hands-free operation of the light sources, camera(s), and/or microphone(s) may be facilitated using the switch actuator that can be pressed against the wearer's shoulder.

Figure 9:
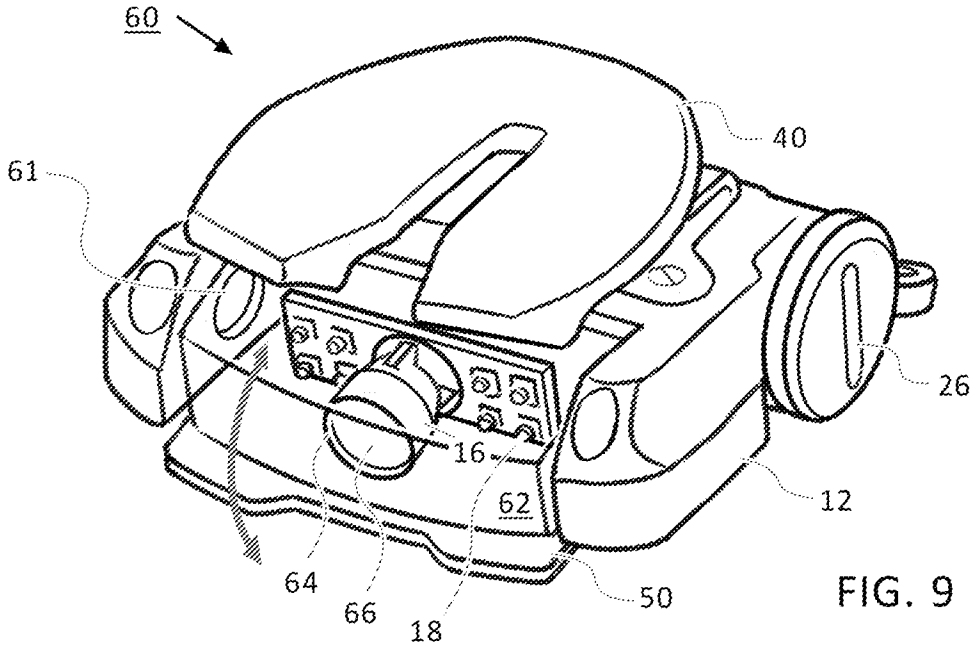
FIG. 9 illustrates an example of an illumination device configured in accordance with a further embodiment of the present invention.

Referring now to FIGS. 9 and 10A-10E, a further example of an illumination device 60 configure in accordance with embodiments of the present invention is shown. In this example, the illumination device 60 includes a lens assembly 64 having a parabolic reflector 66 associated with the primary illumination source 16. This allows for focusing and/or filtering of the light from primary illumination source 16. Secondary illumination sources 18 are again positioned to the sides of the primary illumination source, and all of the illumination sources are placed behind a protective cover 62. The protective cover may be semi-opaque at the frequencies of the primary and secondary illumination sources, and may thus act as a diffuser for the emitted light therefrom. The use of such a diffuser can assist in eliminating hard shadows that may otherwise be cast if point source illumination sources are used. Protective cover 62 may be made of plastic or another material. Visible in FIG. 9 is a pivot joint 61 about which the front portion of illumination device 60 containing the primary and secondary illumination sources can pivot within housing 12. Rather than the entire illumination device 60 pivoting about a hinge at the rear of the clip, as in the embodiment discussed above with respect to FIGS. 1 and 3-6, in this example only the portion of the illumination device that includes the illumination sources is pivotable (as indicated by the arrow in front of the illumination device). Accordingly, when clipped onto a strap or other mounting means, the orientation of housing 12 remains relatively unchanged when the direction of the illumination provided by the illumination sources is changed. This is beneficial because the activation switches/buttons for the illumination source, which are mounted on/in the housing, remain relatively unchanged when altering the direction of illumination, allowing a user to quickly switch between illumination sources, vary the illumination program therefor, and/or activate/deactivate one or more of the illuminations sources.

Figure 10A:
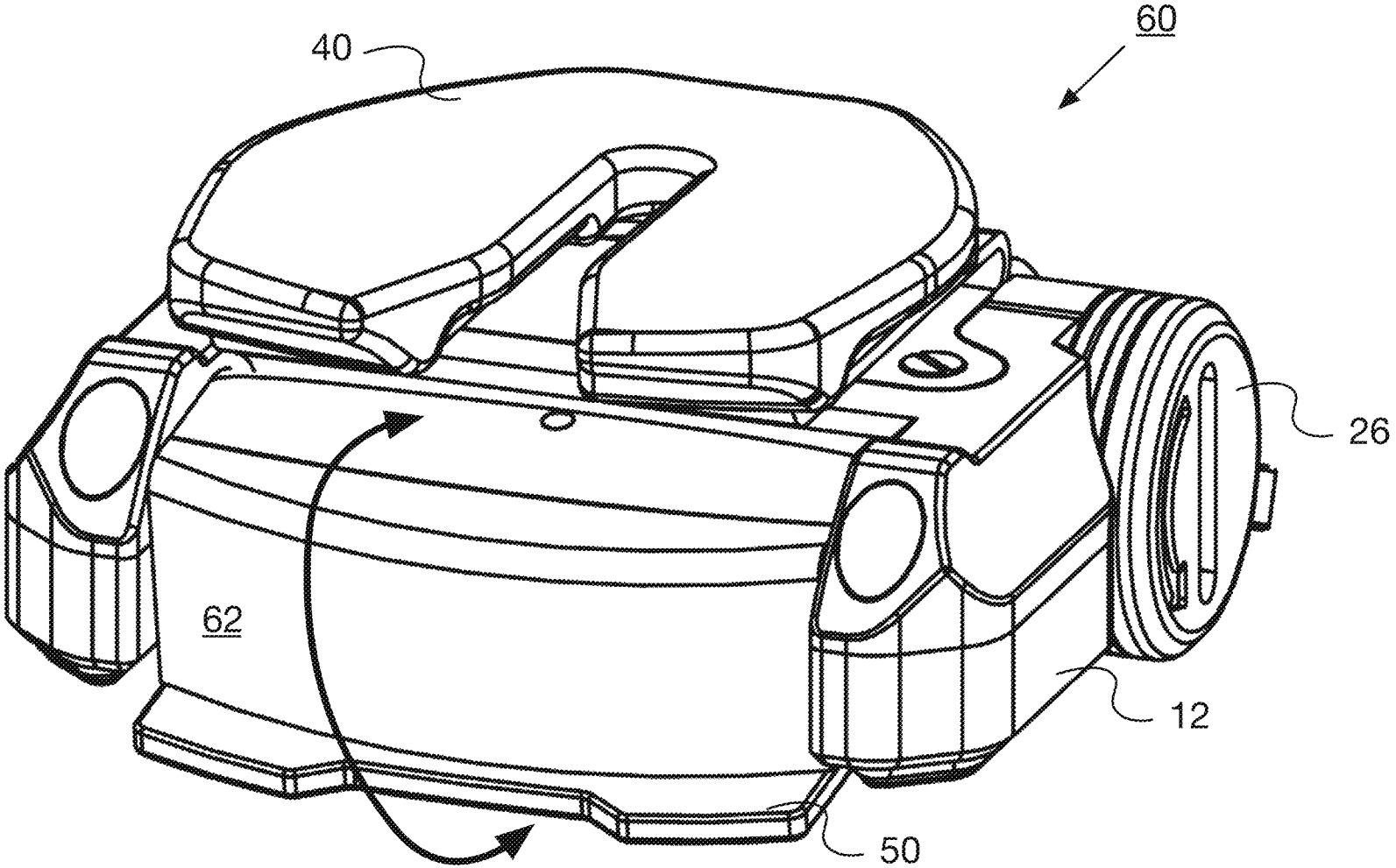
FIGS. 10A-10E further illustrate aspects of the illumination device shown in FIG. 9.
Figure 10B:
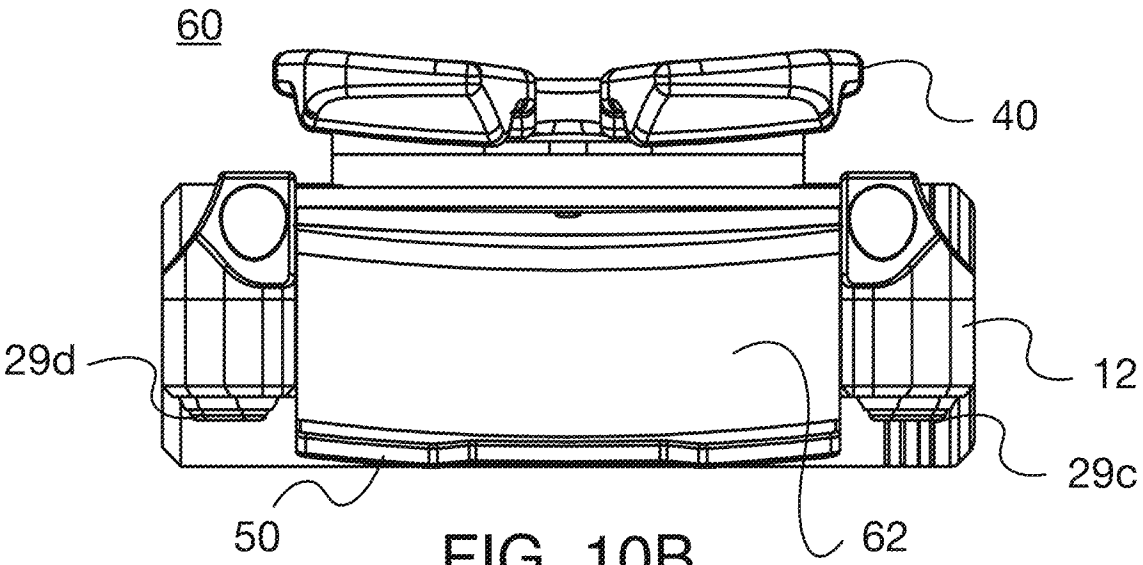
Figure 10C:
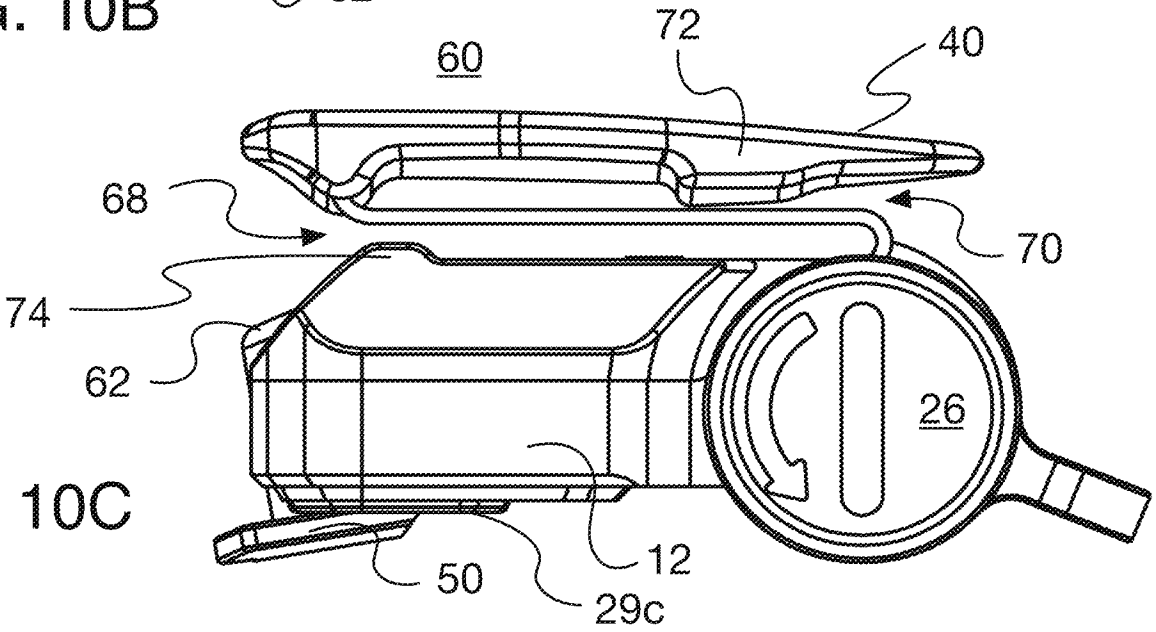
Figure 10E:
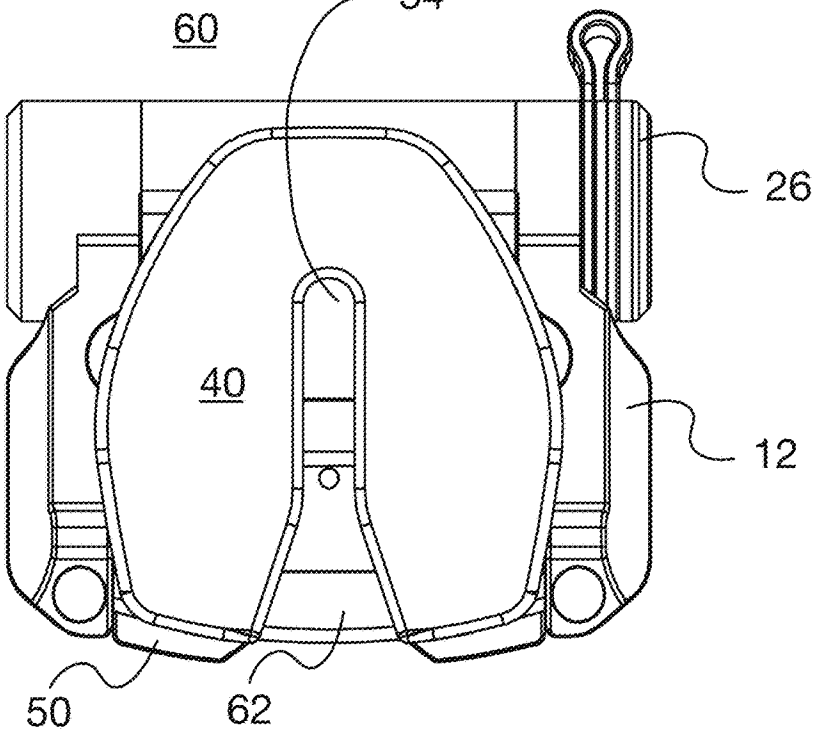
Figure 10D:
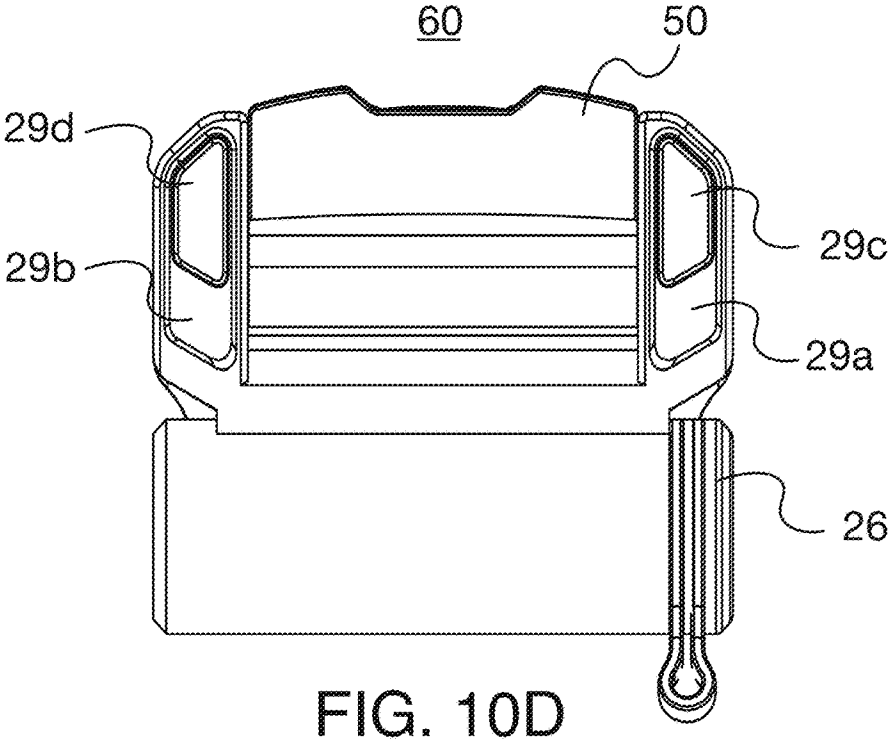

FIG. 10A is an isometric view of the illumination device 60, while FIG. 10B is a front view thereof, FIG. 10C a left-side view thereof, FIG. 10D a bottom view thereof, and FIG. 10E a top view thereof. FIG. 10C in particular highlights the features of clip 40. As shown, clip 40 is associated with two gaps 68, 70, each of which may receive a strap or other mounting means. The gaps 68, 70 may be of different sizes (widths) and may thus accommodate different mounting means. Gap 68 is loadable from the front of illumination device 60, while gap 70 is loadable from the rear thereof. A detent 72 is provided so as to prevent a strap or other mounting means to become displaced from gap 70 once fitted therein. A similar detent 74, provided on housing 12, is associated with gap 68. Preferably, gap 68 is sized to accommodate strap-like webbing, while gap 70 is sized to accommodate chin straps, head straps, straps associated with hand or glove mounts, etc.

Although not shown specifically, the clip 40 may be swivelly mounted on the top of housing 12. This allows the entire illumination device to be rotated through an arc of up to 360 degrees in a plane defined by the connection between the clip and the housing. Any of a variety of swivel joints may be used for such a connection. For example, the clip may be fitted with a cylindrical post at its bottom, which post may turn freely, or in a ratchet fashion, in a receiving support structure in or on housing 12. A ratchet joint would allow the azimuthal direction of the illumination device to be set without fear that it will easily deviate therefrom. The same may be accomplished using a snuggly fitting friction joint, for example as provided by overlapping, hollow cylindrical posts associated with the clip and housing that are prevented from coming apart by flanges on their ends. The rotating attachment of clip 40 and housing 12 is optional but advantageous in certain applications of the illumination device.

Figure 11:
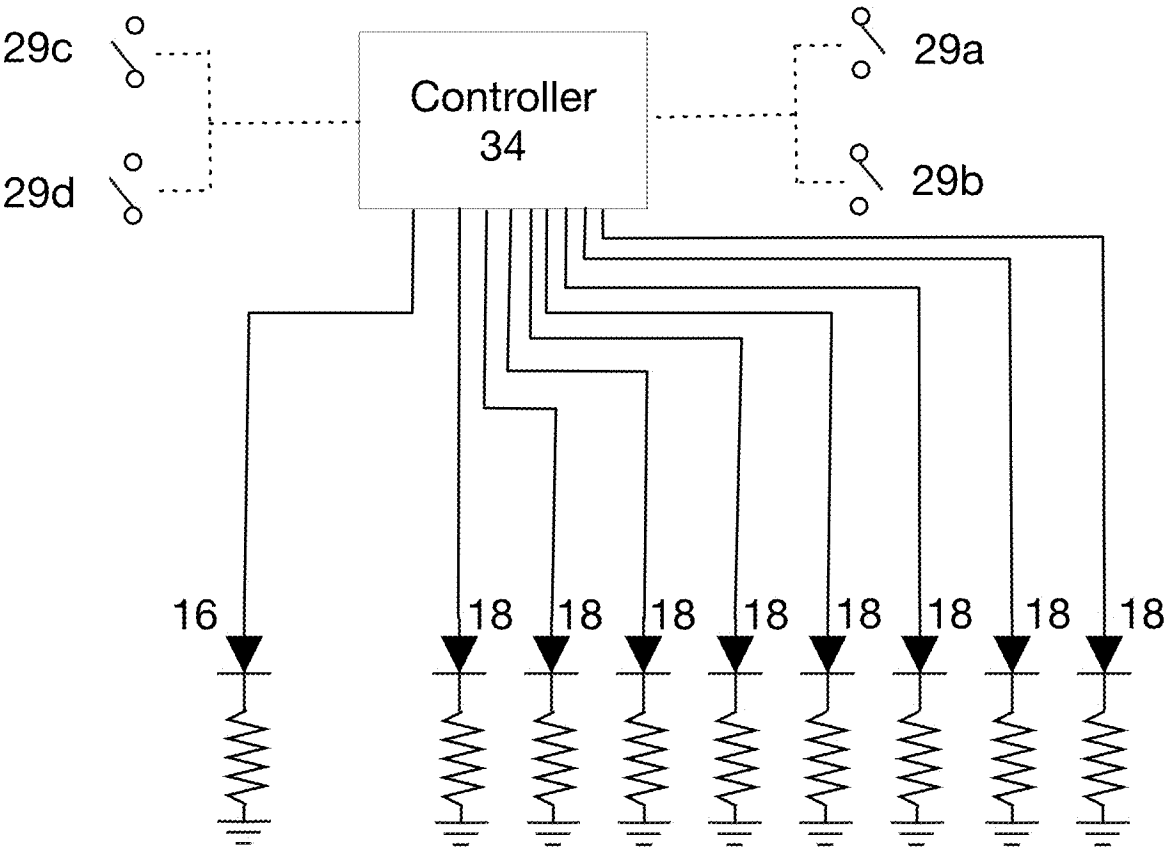
FIG. 11 is a simplified schematic showing electronic circuitry for the illumination device shown in FIGS. 10A-10E.

FIGS. 10A-10E also highlight other features of illumination device 60. For example, as shown in FIG. 10D, various over molded buttons 29*a*-29*d* are provided for the operation of the illumination sources. The buttons may be arranged in pairs, with buttons 29*a* and 29*b* controlling the operation of the secondary illumination sources 18, and buttons 29*c* and 29*d* controlling the operation of the primary illumination source 16. As such, these buttons would replace the hands-free switch 28 described above. An example of such a control system is shown in the simplified schematic illustrated in FIG. 11. A catch tab 50 is provided that allows the wearer to adjust the direction of illumination by pivoting the front portion of the illumination device on pivot assemblies 61 (see FIG. 10A). For example, a user may manipulate the catch tab 50 using the back of his/her hand or wrist (e.g., when the illumination device is worn on a chin strap), allowing easy adjustment of the direction of illumination.

Thus, illumination devices and, more particularly, such illumination devices as are intended to be worn on the person of a user, have been described.

What is claimed is:

1. An illumination device, comprising one or more light sources included in a lens assembly pivotably disposed within a housing and protected by a covering diffuser, said housing being attached to a clip adapted to receive a mounting means, one or more of said light sources operable by a hands-free switch mounted on an opposite side of the housing from the clip when the clip is in a closed position.

2. The illumination device of claim 1, wherein the one or more light sources comprise light emitting diodes (LEDs).

3. The illumination device of claim 1, wherein the clip is adapted to receive a strap as a mounting means.

4. The illumination device of claim 1, wherein the clip is shaped to be worn under a wearer's chin.

5. The illumination device of claim 1, further including one or more imaging devices in the housing.

6. The illumination device of claim 1, wherein one of said light sources is operable by said hands-free switch and others of said light sources are operable by one or more other switches.

7. The illumination device of claim 1, wherein one of said light sources is operable by said hands-free switch and others of said light sources are operable under the control of a programmable controller.

8. An illumination device comprising a light source included in a lens assembly and operable by a hands-free switch mounted to a housing including said light source, said lens assembly protected by a covering diffuser and pivotably attached to said housing, and said housing being rotatably attached to a clip adapted to receive a strap.

9. The illumination device of claim 8, wherein the light source comprises a light emitting diode (LED).

10. The illumination device of claim 8, wherein the clip includes a groove adapted to facilitate attachment of the illumination device to strap-like webbing.

11. The illumination device of claim 8, wherein the clip has an upper surface cupped to receive a wearer's chin.

12. The illumination device of claim 8, wherein the hands-free operable switch is mounted on an opposite side of said housing from said clip when said clip rests on an upper surface of said housing.

13. The illumination device of claim 8, further comprising audio communications means included in said housing.

14. The illumination device of claim 13, wherein the audio communications means includes a microphone.

15. The illumination device of claim 8, wherein the housing comprises one or more of plastic, metal and/or a metal alloy, carbon fiber, cellulose acetate, and an epoxy resin.

16. An illumination device comprising a light source operable by a hands-free switch mounted to a housing including said light source, said light source included in a lens assembly having a parabolic reflector, protected by a covering diffuser, and being pivotable within said housing, and said housing being attached to a U-shaped clip loadable from both a front side and a back side of the illumination device.

17. The illumination device of claim 16, wherein the U-shaped clip defines two gaps, one of which is loadable from the front side of the illumination device front side and another of which is loadable from the back side of the illumination device, the two gaps being different in size.

18. The illumination device of claim 16, wherein the U-shaped clip is rotatably attached to the housing.

19. The illumination device of claim 16, wherein the U-shaped clip is hingibly attached to the housing.

20. The illumination device of claim 16, wherein the U-shaped clip is both hingibly and rotatably attached to the housing.

* * * * *